United States Patent [19]

Morgan

[11] Patent Number: 4,815,721

[45] Date of Patent: Mar. 28, 1989

[54] FILM LOADER AND UNLOADER MECHANISM

[75] Inventor: Thomas A. Morgan, Billerica, Mass.

[73] Assignee: Honeywell Bull Inc., Waltham, Mass.

[21] Appl. No.: 774,194

[22] Filed: Sep. 9, 1985

[51] Int. Cl.[4] ..... B65H 5/22

[52] U.S. Cl. ..... 271/3.1; 271/5; 271/98; 271/104; 271/105; 271/211; 270/52; 354/4

[58] Field of Search ..... 271/3, 3.1, 4, 5, 97, 271/98, 104, 105, 194, 195, 11, 14, 103, 264, 267, 306, 84, 211; 414/752, 116, 121; 354/4; 355/72, 73, 97, 99, 103, 54; 270/52

[56] References Cited

U.S. PATENT DOCUMENTS

| | | | |
|---|---|---|---|
| 3,582,063 | 6/1971 | Gnage | 271/5 |
| 3,879,031 | 4/1975 | Melehan | 271/104 X |
| 3,938,800 | 2/1976 | Wirz | 271/98 |
| 3,980,293 | 9/1976 | Shelmire | 271/98 |
| 4,031,400 | 6/1977 | Hunt et al. | 271/3 |
| 4,212,263 | 7/1980 | Hillhouse | 271/4 X |
| 4,220,323 | 9/1980 | Smith et al. | 271/65 |
| 4,295,565 | 10/1981 | Takeuchi | 206/455 |
| 4,306,684 | 12/1981 | Peterson | 271/97 |
| 4,312,617 | 1/1982 | Livingston et al. | 271/104 X |
| 4,317,563 | 3/1982 | Zimmerman et al. | 271/211 |
| 4,382,593 | 5/1983 | Beran et al. | 271/98 |
| 4,389,117 | 6/1983 | Floyd et al. | 355/99 |
| 4,405,125 | 9/1983 | Kulpa et al. | 271/211 X |
| 4,483,527 | 11/1984 | Hashimoto et al. | 271/5 |
| 4,502,677 | 3/1985 | Senga et al. | 271/104 |
| 4,571,073 | 2/1986 | Diedrich et al. | 271/5 |
| 4,575,235 | 3/1986 | Powers | 355/99 |

*Primary Examiner*—Kevin P. Shaver
*Assistant Examiner*—David H. Bollinger
*Attorney, Agent, or Firm*—Faith F. Driscoll; John S. Solakian

[57] ABSTRACT

A loader and unloader mechanism is attached to a standard photoplotter equipment. The mechanism performs a sequence of operations for loading and unloading sheets of film onto and from respectively such equipment completely automatically.

19 Claims, 18 Drawing Sheets

FILM LOADER AND UNLOADER MECHANISM

BACKGROUND OF THE INVENTION

1. Field of Use

This invention relates to photoplotter equipment and more particularily to techniques for loading and unloading photographic media from such equipment.

2. Prior Art

It has been found that generally the production of artwork is limited to manually processing one or possibly two finished pieces of artwork during a single day. The processing operation normally involves the manual loading of a single sheet of unexposed artwork film in a dark room environment onto the artwork generating photoplotter equipment. A period of six or seven hours is generally required for generating the completed artwork which corresponds to a printed wiring plot for one layer of a printed wiring board. Each such board normally contains from six to twelve layers.

When the photoplotting equipment has processed a piece of artwork film, an operator removes the finished artwork film and then loads a second piece of film onto the photoplotter equipment. At the beginning of the second day or shift, the second artwork film is removed by the operator.

It can be seen from the above that this process is quite time consuming and requires operator intervention.

It is a primary object of the present invention to provide a mechanism or device which can be attached to existing photoplotter equipment without modification and permit such equipment to continously process sheets of artwork film without manual intervention.

It is a further object to provide a fully automatic film loading and unloading mechanism which can be used in conjunction with existing artwork photoplotting equipment.

SUMMARY OF THE INVENTION

The above and other objects of the present invention are achieved in a preferred embodiment of an automatic film loader and unloader mechanism. The mechanism can be attached to existing artwork photoplotter equipment without having to modify such equipment. The major parts of the mechanism include a removable pneumatically controlled carriage assembly and a storage and control unit. The carriage assembly contains linear movement cylinder apparatus which attaches to vacuum controlled suction cup gripping apparatus. The apparatuses cooperate to pick up and deliver single sheets of photosensitive material to and from the photoplotter equipment.

In the preferred embodiment, the carriage assembly attaches to a top section of the storage and control unit by a plurality of slotted stop friction blocks mounted thereon. The top section of the storage and control unit further includes removable linear way and guide bar apparatus which correctly positions the carriage assembly during the delivery of the single sheet of photosensitive material to and from the photoplotter equipment. The remaining sections of the storage and control unit are used for storing a supply of unexposed sheets of photosensitive material to be continuously processed, storing processed sheets of photosensitive material and for housing the electromechanical and pneumatic units which automatically sequence the mechanism through the operations necessary for loading and unloading the photoplotter equipment.

According to the teachings of the present invention, the sheets of unexposed photosensitive material, hereafter film, are stacked in a predetermined manner within the storage and control unit. That is, in the preferred embodiment, each sheet of unexposed photosensitive material is alternated with a sheet of specially treated antistatic paper of like thickness which both protects and separates the sheets of film from one another. The sheets of paper are inserted underneath the stop friction, blocks and laminated/separated by film separator tabs. The end of the sheets of paper and film separator stop tabs are clamped or pinched together by tension cylinder means included within the stop friction blocks. During initial loading, the individual sheets of film are slid into place so they abut with the stop tabs.

This stacking arrangement ensures that only a single sheet of film is removed at a time. The stop tabs act as stops for the sheets of film during initial loading. They also provide an air space between the sheets of paper ensuring proper separation notwithstanding static.

The carriage assembly of the preferred embodiment utilizes pneumatically controlled gripping apparatus which takes the form of a plurality of pneumatic cylinder chambers which attach to a corresponding number of suction cups. Each time a vacuum is applied to the cylinder chambers, the suction cups are conditioned after gripping a sheet of film to move through the same predetermined sequence of holding positions (e.g., lift the film to a first position and then to a second position). When the vacuum is eliminated by venting the chambers, the suction cups are conditioned to move backwards through the same holding positions and then release the sheet of film.

The above pneumatic chamber arrangement provides a reliable way of controlling film pick up and depositing. It eliminates the need for complicated pneumatic controls and valve arrangements thereby simplifying the overall construction of the mechanism of the present invention. The mechanism provides a low cost attachment to existing photoplotter equipment. When the photoplotter equipment completes the processing of a sheet of film, it moves it's platen to a predetermined position. This results in the depression of a push button switch mounted on the side of the storage and control unit. This contact provides a start signal which initiates a sequence of operations which first unloads the processed sheet of film from the platen of the photoplotter equipment and then loads a new sheet of unexposed sheet of film onto the same platen. After the completion of the unload/load sequence, the mechanism remains in a standing mode. It remains in that state until it receives another start signal. Hence, it does not in any way interfere with either the control or operation of the photoplotter equipment. Moreover, it does not require that any modification be made to the photoplotter equipment or the manner in which it has been programmed.

The novel features which are believed to be characteristic of the invention both as to its organization and method of operation, together with further objects and advantages will be better understood from the following description when considered in connection with the accompanying drawings. It is to be expressly understood, however, that each of the drawings are given for the purpose of illustration and description only and are not intended as a definition of the limits of the present invention.

DESCRIPTION OF THE PREFERRED EMBODIMENT

Figure 1:
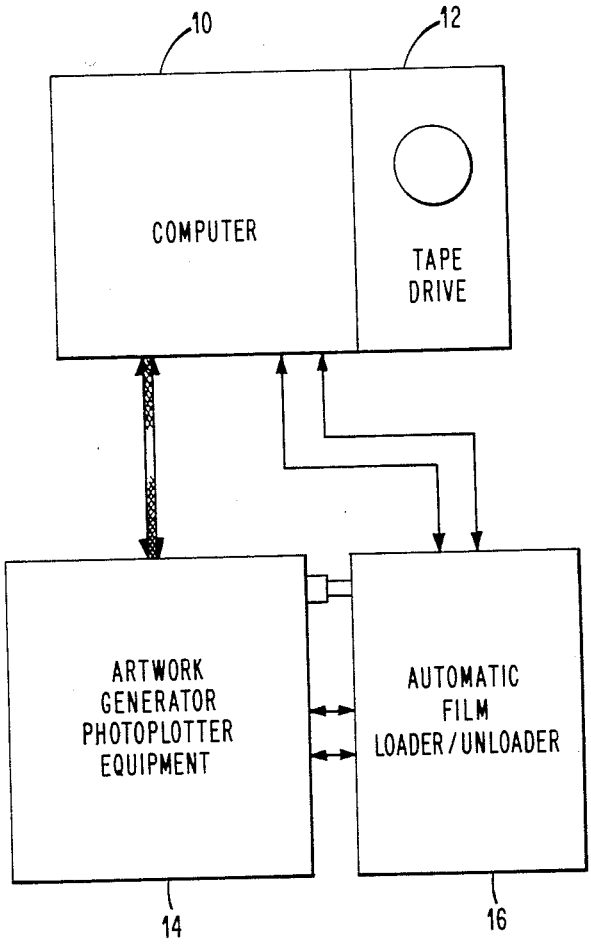
FIG. 1 is a block diagram of a typical photoplotter system which can use the loader/unloader apparatus of the present invention.

FIG. 1 shows in block diagram form a photoplotter system which includes the loader/unloader mechanism of the present invention. As seen from the Figure, the system includes a computer 10, a tape drive device 12 and an artwork generator photoplotter device 16. As shown, the tape drive device 12 and photoplotter 16 couple to and are controlled by computer 10. For the purpose of the present invention, computer 10, tape drive device 12 and photoplotter 14 may be considered conventional in design. For example, photoplotter 14 can be a laser-controlled artwork generator Model 1434 manufactured by The Gerber Scientific Instrument Company. The photoplotter 14 includes a base cabinet 14-18 which houses an X-Y table 4—14, a platen 14-12 and a top mounted laser aperature head within an enclosure 14-16.

This photoplotter is operated manually. That is, an operator is required to place a sheet of film on the plotter platen, load the tape drive device 12 and depress a button to start the artwork generation process.

In the system of FIG. 1, the tape drive device 12 is used to store coded information representative of the line patterns, pads, dimensions, etc. on sheets of unexposed film to be plotted. These sheets correspond to the different layers of a printed wiring board. The computer 10 operates to access and process the stored coded information on tape which results in computer 10 directing the positioning of the laser head system of the photoplotter 14 to move its table top 14—14 and platen 14-12 in the appropriate X and Y directions to create the desired artwork patterns.

Figure 8:
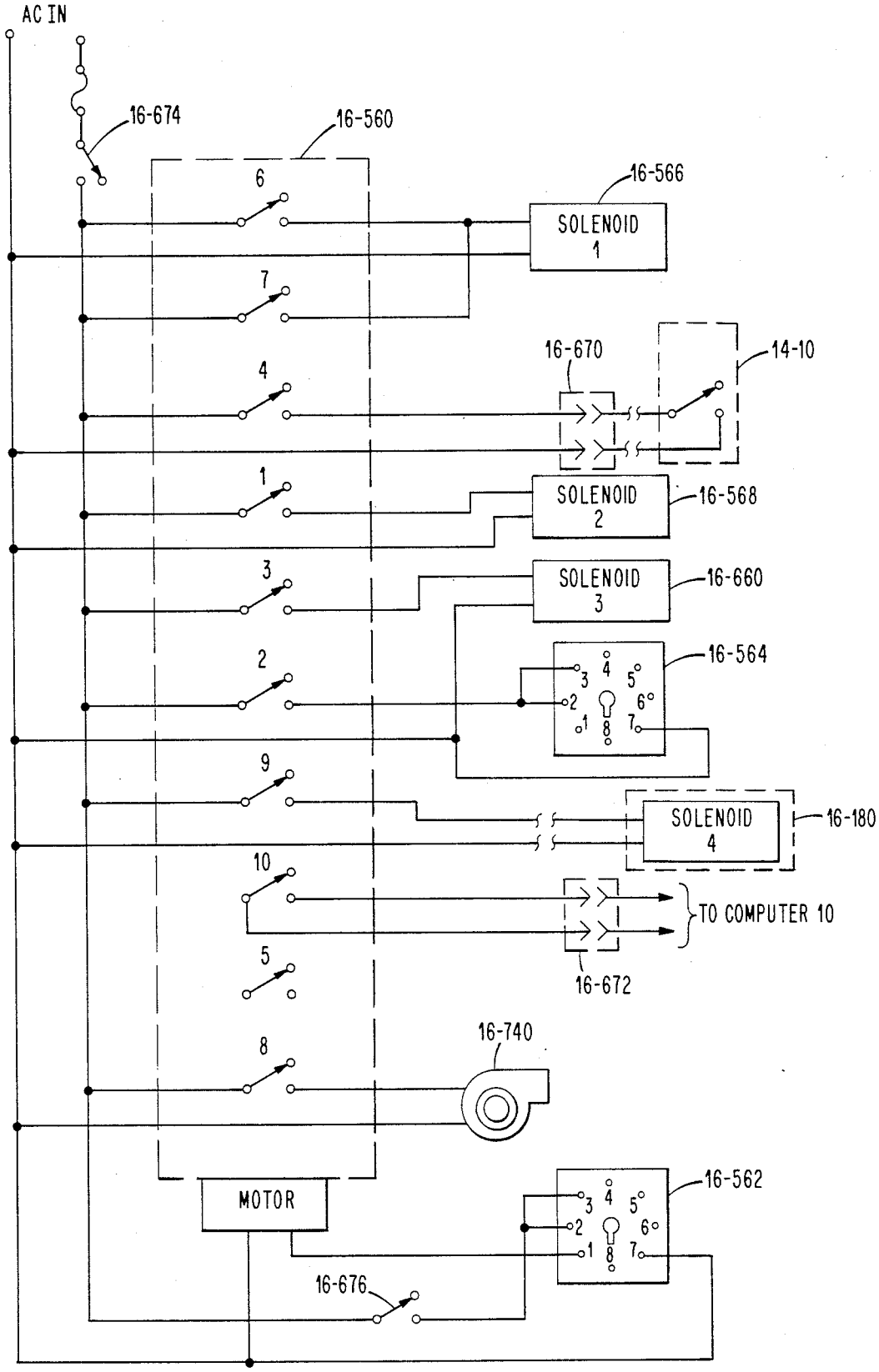
FIG. 8 is a schematic diagram of the arrangement of the control circuits of FIG. 7.

The film loader/unloader mechanism 16 of the present invention electrically and mechanically couples to photoplotter 14 through a simple interface shown in FIG. 8. The mechanism 16 is connected to receive the required power signals from computer 10 as shown. Additionally, mechanism 16 operates to apply a signal to computer 10 indicating when it has completed the unload/load sequence at which time the computer 10 can cycle the photoplotter 14 to plot another sheet of film. The signal interconnections between mechanism 6, computer 10 and photoplotter 14 are made so that both the photoplotter 14 and computer 10 can be manually operated as before without being connected to mechanism 16. Also, no modifications are required to be made to the programming and photoplotter system in order to be operated with mechanism 16 as explained herein.

Figure 2:
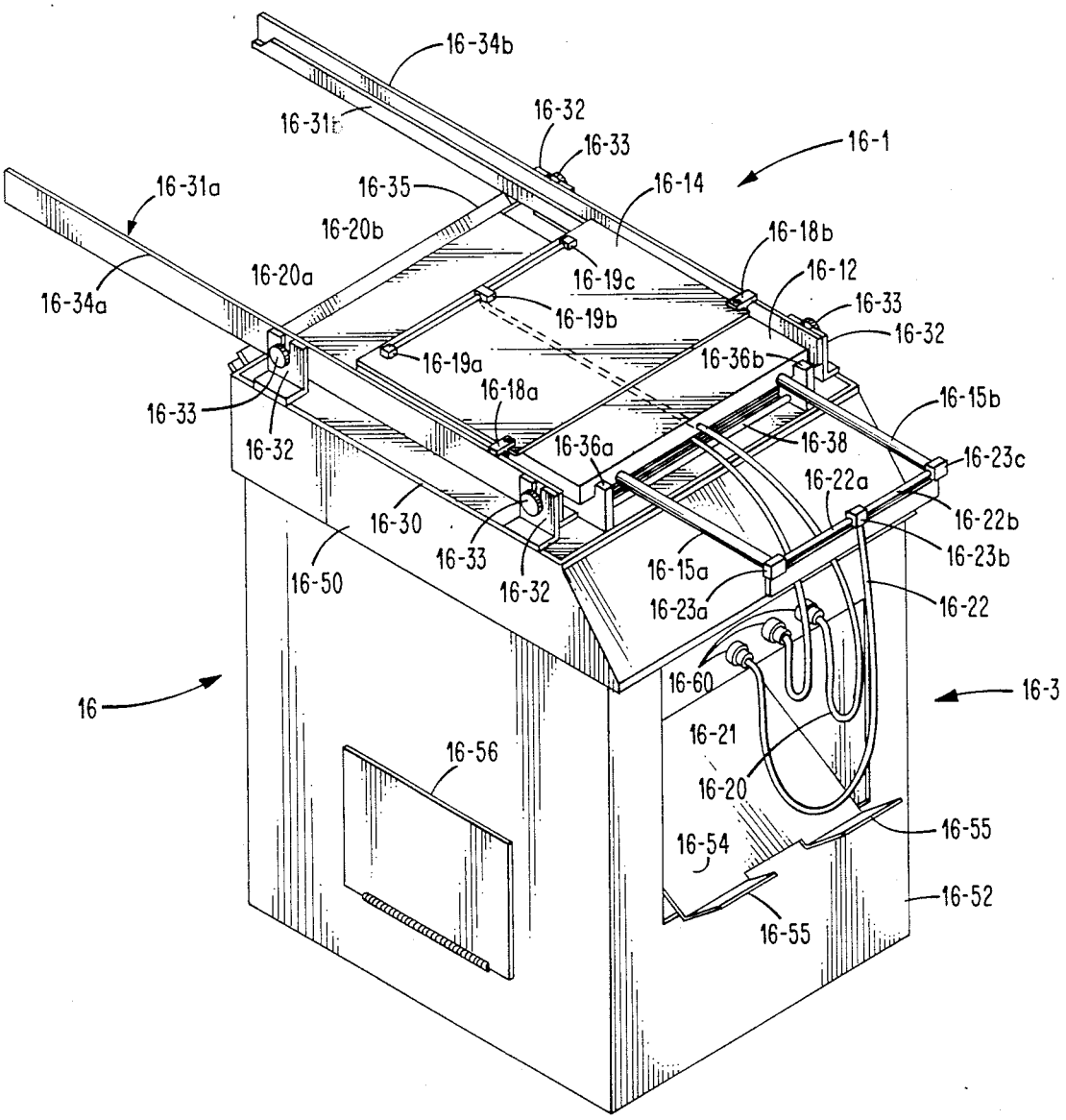
FIG. 2 is an overall perspective view of the loader-/unloader apparatus of the present invention.

FIG. 2 is an overall perspective view of loader/unloader mechanism 16. As shown, mechanism 16 includes a removable carriage assembly 16-1 and a storage and control unit 16-2. The carriage assembly 16-1 includes a stationary metal cover 16-12 approximately square in shape, a movable metal cover 16-14, a vaccuum controlled suction cup gripping assembly 16—16 fastened to cover 16-14 and a pair of "T"-shaped plastic guides 16-18*a* and 16-18*b* also fastened to cover 16-14 shown in greater detail in FIG. 3. The stationary cover 16-12 houses a pair of linear cylinders 16-15*a* and 16-15*b* and acts a resting place or support for movable cover 16-14 and gripping assembly 16—16 which is shown completely retracted position.

A plastic hose 16-20 feeds into a "T" connection fitting 16-19*b* at the other end. Each of the hose sections 16-20*a* and 16-20*b* attach to elbow connections or fittings 16-19*a* and 16-19*c* at each end. The connections couple to a bar member located at the left below hose sections 16-20*a* and 16-20*b*, not shown, which spans the width of movable cover 16-14. At each end of the bar, a ball bearing roller is attached (i.e., roller 16-17 in FIG. 3). The rollers are constructed to have nylon outer races for noiseless and wear-free operation. As explained herein, the rollers ride along removable linear ways 16-30*a* and 16-30*b* of the storage and control unit 16-2. Each of the "T"-shaped guides 16-18*a* and 17-18*b* fasten to the sides of movable cover 16-14 which guide the movement of cover 16-14.

The bar member contains a plurality of cylinders which control the vertical movement of a corresponding number of suction cups used to hold and lift the individual sheets of film. A hose 16-22 connects to a "T" connection 16-23 which at either end connects to hose sections 16-22*a* and 16-22*b*. Each of hose sections 16-22*a* and 16-22*b* connects to elbow connections 16-23*b* and 16-23*c* respectively as shown. The elbow and T connections attach to a bar 16-24 which provides a counterweight to cover 16-14 and support for hose sections T and elbow connections.

Hose 16-22 controls the outward linear motion of the cylinder rods and the vaccuum controlled suction cup gripper assembly attached thereto and the movable cover 16-14. That is, cylinders 16-15*a* and 16-15*b* remain stationary and have movable linear rods which are fastened to the bar by the screws of the face plates mounted thereon. A hose 16-21 shown in FIG. 3 which attaches underneath stationary plate 16-12 is used to control the inward linear motion of the cylinder rods.

The storage and control unit 16-3 includes a table top plate 16-30 constructed of ½ inch aluminum material. The plate 16-30 attaches to the tops of three separate pieces of sheet metal which are contoured to form a cover 16-50 for a metal cabinet 16-52.

Figure 3:
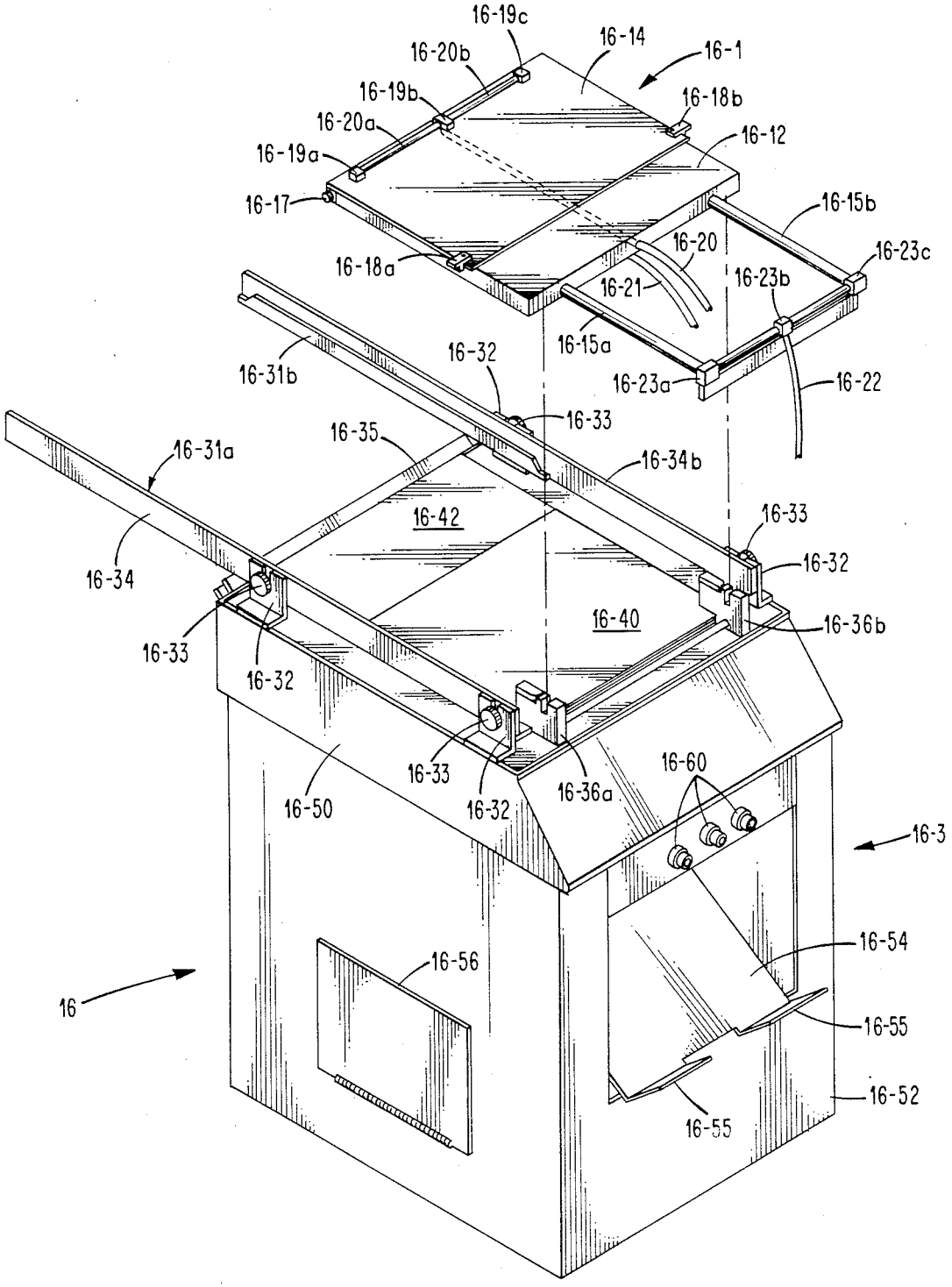
FIG. 3 is an exploded perspective view of the loader-/unloader apparatus of the present invention.

Attached to table top 16-30 by means of mounting screws 16-30 are a pair of stop blocks or friction stands 16-36*a* and 16-36*b*, shown in greater detail in FIG. 3. An air separator tube 16-38 is positioned between the two stop blocks 16-36*a* and 16-36*b*. It is fed with compressed air from both stop blocks 16-36*a* and 16-36*b* and contains a number of uniformly distributed holes that permit air to be blown into the rear of the unexposed sheets of film held in place on table top 16-30 by stop blocks 16-36*a* and 16-36*b*. This permits proper separation of the sheets of film notwithstanding the presence of static, etc.

As seen from FIG. 3, the top of each of the stop blocks 16-36*a* and 16-36*b* is slotted to provide proper placement and positioning of the top cover carriage assembly 16-1 onto the top of unit 16-3.

As previously mentioned, unit 16-3 includes linear ways 16-31*a* and 16-31*b* which attach to larger guide bars 16-34*a* and 16-34*b* as shown in FIG. 3. The bars 16-34*a* and 16-34*b* attach to top plate cover 16-30 by means of four angle brackets 16-32 which are held in place by four threaded knobs 16-33. Both the bars 16-34*a* and 34*b* and linear ways 16-31*a* and 16-31*b* are removable for ease of removing the loader/unloader mechanism 16 from the photoplotter of FIG. 1.

Cabinet 16-52 provides storage for the processed sheets of film which are received by a chute 16-35. The sheets are stacked on a metal shelf 16-54 with stops 16-55 at the end and are easily removed through the opening at the rear of cabinet 16-3. The portion of the shelf 16-54 inside the cabinet 16-52 spans the entire width of the cabinet 16-52. The shelf is flanged at the sides and attaches to both sides of the cabinet by screws such that a sheet of film approximately the full width of the cabinet can be dropped down onto sheets stacked on the shelf without coming into contact with any structure.

Additionally, cabinet 16-52 houses a fan or blower for floating the film onto the shelf 16-54, a compressed air storage tank and all of the electric, pneumatic and vacuum controls. The controls are located on the inside of a hinged door 16-56 of cabinet 16-52. The hinged door can be swiveled down for ease of maintenance or adjustment. Also, at the rear are three disconnects 16-50 for the top cover hoses 16-20, 16-21 and 16-22. This permits connection and disconnection of hoses 16-20, 16-21 and 16-22 from cabinet 16-52 for ease of removal of top cover 16-1 as seen from FIG. 3.

FIG. 3 is a perspective view of the loader/unloader mechanism 16 of the present invention showing how the carriage assembly 16-1 can be removed from the stop blocks 16-36*a* and 36*b* of storage and control unit 16-3. Also, it can be more readily seen how a desired number of sheets of unexposed film 16-20 are stacked on top of top plate 16-30. The number of sheets 16-40 ranges from one to ten sheets of film. As described in greater detail, the sheets of film 16-40 are alternated with longer sheets of specially treated paper 16-42 as shown.

Figure 4A:
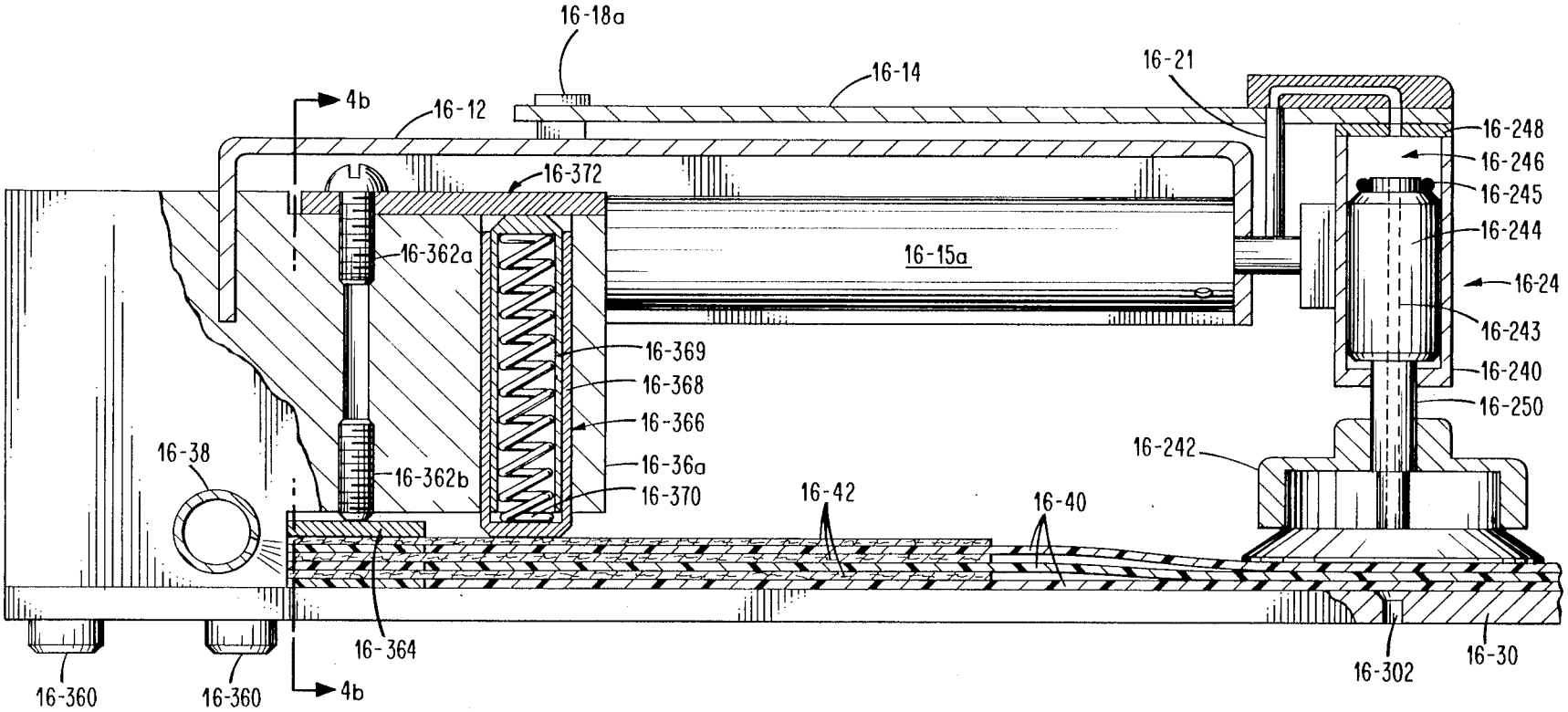
FIGS. 4*a* and 4*b* are enlarged cross section views of portions of the carriage assembly and top section of the storage and control unit of FIG. 2.

FIG. 4*a* shows in greater detail an enlarged cross section view of the stop block (e.g. 16-36*a*) of unit 16-3 and suction cup gripper assembly of carriage assembly 16-1. The same reference numerals are used for the same elements in FIG. 1 as in this Figure as well as the other Figures.

As seen from the Figure, the stop block 16-32*a* is attached to the table top plate 16-30 by two mounting screws 16-360. As shown, plate 16-30 includes an air channel or hole 16-302. At the top of stop block 16-36*a* is a set screw 16-362 which applies pressure to a block or clamp 16-364 arranged to hold the sheets of paper 16-42 and film separator tabs 16-41 of FIG. 4*c* in place. Clamp 16-364 is approximately one inch square, one quarter inch thick and is located centrally below set screw 16-362. Stop block 16-36*a* further includes a tensioning device 16-366. The device 16-366 is made up of two cylindrical units 16-368 and 16-369 fitted together, cylinder 16-368 over cylinder 16-369 with a spring 16-370 included therein. Tensioning device 16-366 fits into a cylindrical hole at the front edge of the stop block 16-36*a* and applies downward pressure once a latch plate or cap 16-372 is rotated into the position shown. The tension of spring 16-370 contained within device 16-366 is precalibrated to apply a prescribed amount of downward pressure on the stack sheets of film and paper, as explained herein.

The set screw 16-362 has two sections 16-362*a* and 16-362*b*. Section 16-362*b* is adjusted by a set screw to apply the desired tension section 16-362*a* is used to hold the device 16-366 in place.

FIG. 4*a* also shows the manner in which stationary cylinder 16-15*a* couples to the front moving bar 16-240 which attaches to moving cover 16-14. As discussed above, the cylinder 16-15*a* includes a rod 16-150 which threaded at the end to screw into a face plate 16-248. The plate 16-248 is mounted by a pair of screws into bar 16-240. The cylinder 16-15*a* is a double acting cylinder which is conventional in design and may take the form of those devices manufactured by Bimba Corporation.

As shown, the bar 16-240 contains a small pneumatic cylinder 16-244 which attaches to a rod 16-250. The end of rod 16-250 attaches to a suction, cup 16-242 which slides up and down inside a chamber 16-246. A channel or hole 16-243 passes through the cylinder 16-244 and suction cup 16-242 as shown in dotted lines. At the end of cylinder 16-244 is an O-ring 16-245 which is used to prevent any vacuum leakage. The bar 16-240 attaches to a bar cap 16-248 which connects to through a "T" or elbow connection and then through hose 16-21.

Figure 4B:
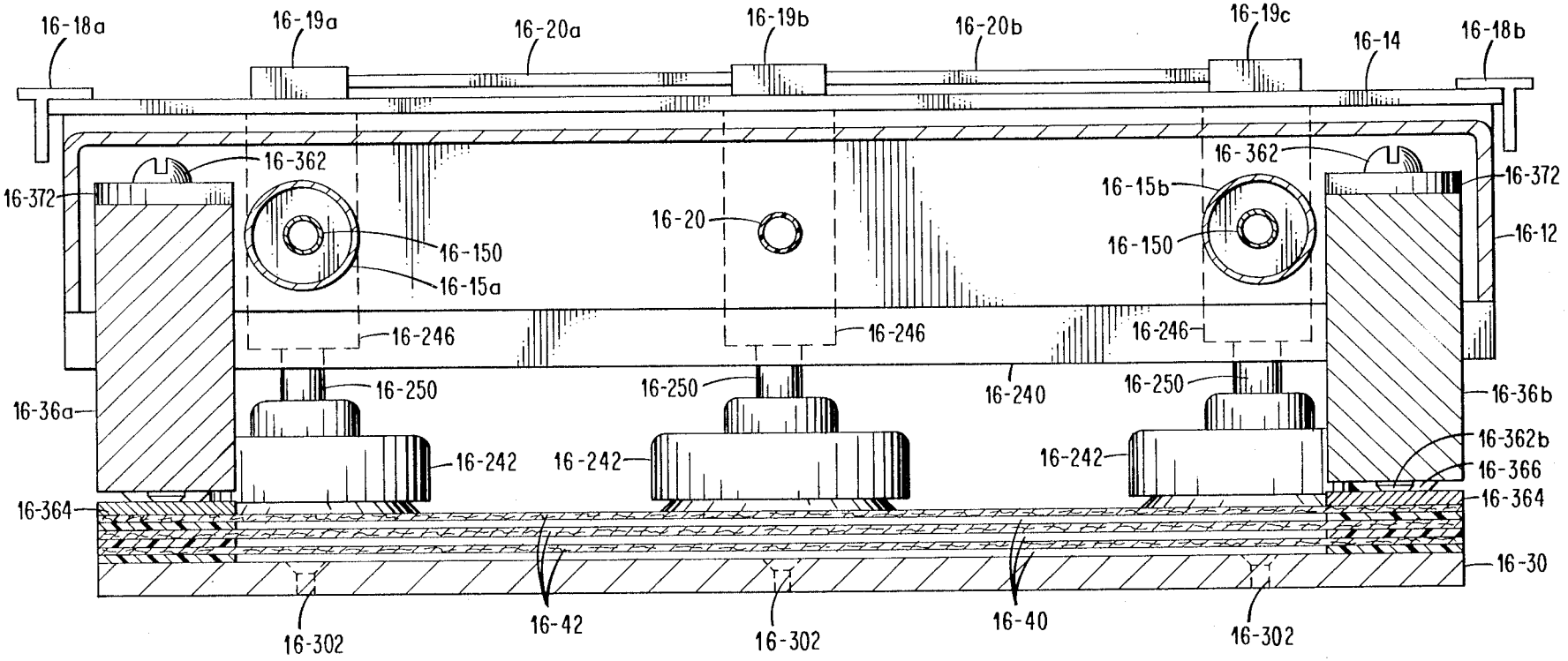

FIG. 4*b* is an enlarged cross section view of the carridge assembly 16-1 and top section of the storage and control unit 16-3. This view shows the ends of both stop blocks 16-36*a* and 16-36*b* and in greater detail the movable bar 16-240 which houses each of the three pneumatic cylinders 16-244. Each cylinder attaches to corresponding ones of the rods 16-250 which attach to the suction cups 16-242.

As shown, the stationary cylinders 16-15*a* and 16-15*b* attach to stationary cover 16-12. The rods 16-150 of both cylinders 16-15*a* and 16-15*b* provide the supply of air from hose 16-22 to force the rods to move in an outward direction while the center air connection provides air received from hose 16-21 into the cylinders to retract or force the rods to move in an inward direction.

Figure 4C:
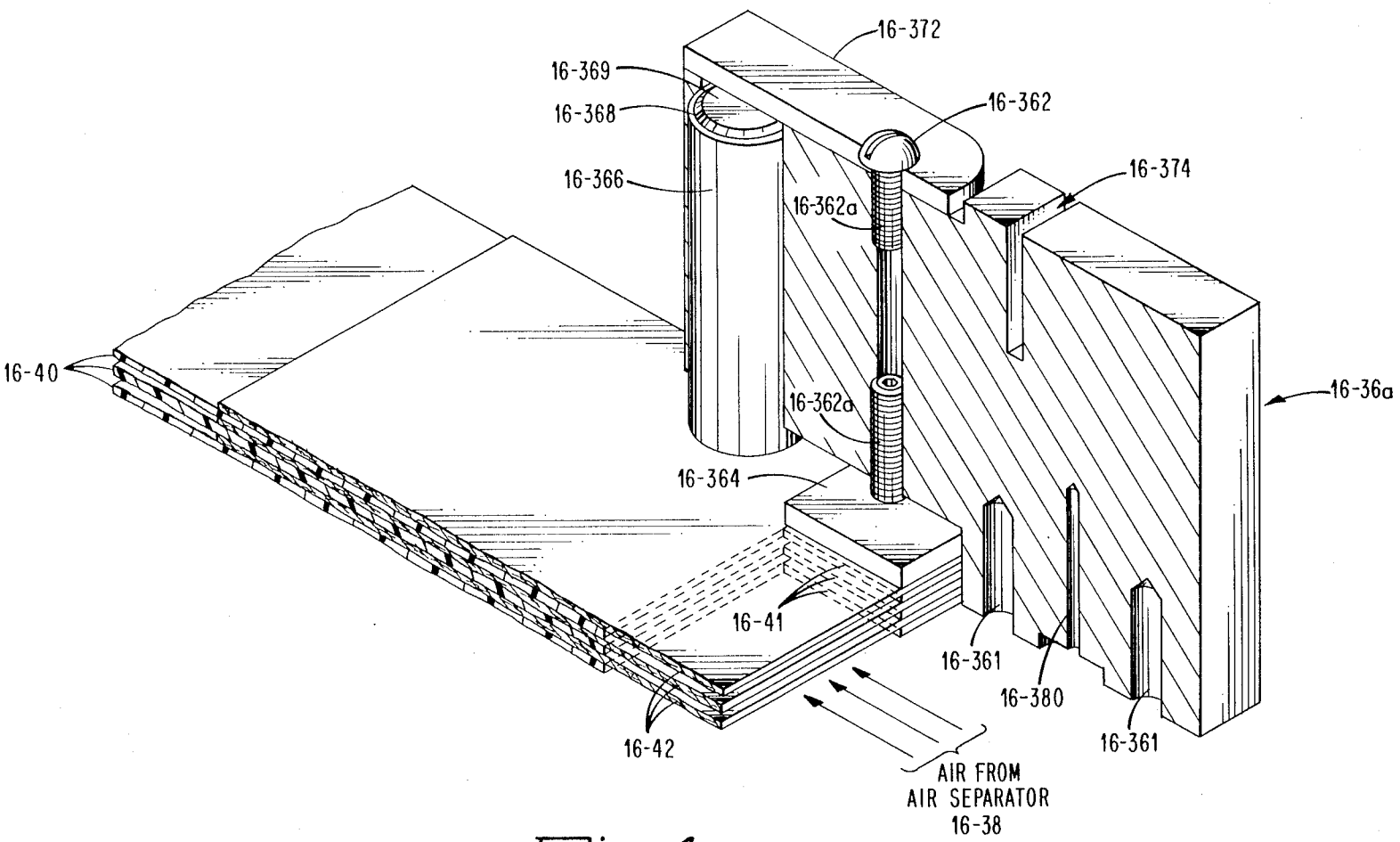
FIG. 4*c* is a cross section view through an axis B—B in FIG. 4*a* showing the alignment of sheets of film according to the teachings of the present invention.

FIG. 4*c* is an enlarged cross section view taken along an axis B—B in FIG. 4*a* showing in greater detail, the construction of the stop block 16-36*a* and the alignment of sheets of film and paper according to the teachings of the present invention. The stop block 16-36*a* as previously mentioned is mounted to the topside of table top plate 16-30 by two mounting screws which fit into two threaded holes 16-361. Between the two holes 16-361 is an air passage 16-380 for feeding compressed air into one side of separator 16-38. Also shown in greater detail is the slot 16-374 into which the stationary cover 16-12 carriage assembly 16-1 is dropped and held in place.

As previously mentioned, the sheets of film 16-40 are separated by sheets of special paper. The sheets of paper are mechanically held into place continuously so that they never move away from stop block friction stand 16-36*a*. To accomplish this, when the sheets of paper are installed underneath friction stand 16-36*a* they are laminated with separate film stop tabs 16-41 which are pieces of unexposed film having the same dimensions as clamp block 16-364. As seen from the Figure, a stack is set up of tabs 16-41 alternated with sheets of paper 16-42. The clamp block 16-364 is placed on top of the stack and the entire stack is held together by set screw 16-362.

The film separator stop tabs 16-41 serve two purposes. When the sheets of unexposed film 16-40 are installed, they act as stops for the sheets of film so they cannot be moved any further into the clamp block 6-364. The stop tabs 16-41 also provide air spaces between the sheets of paper into which air is blown into by the air separator 16-38 as shown.

Figure 7:
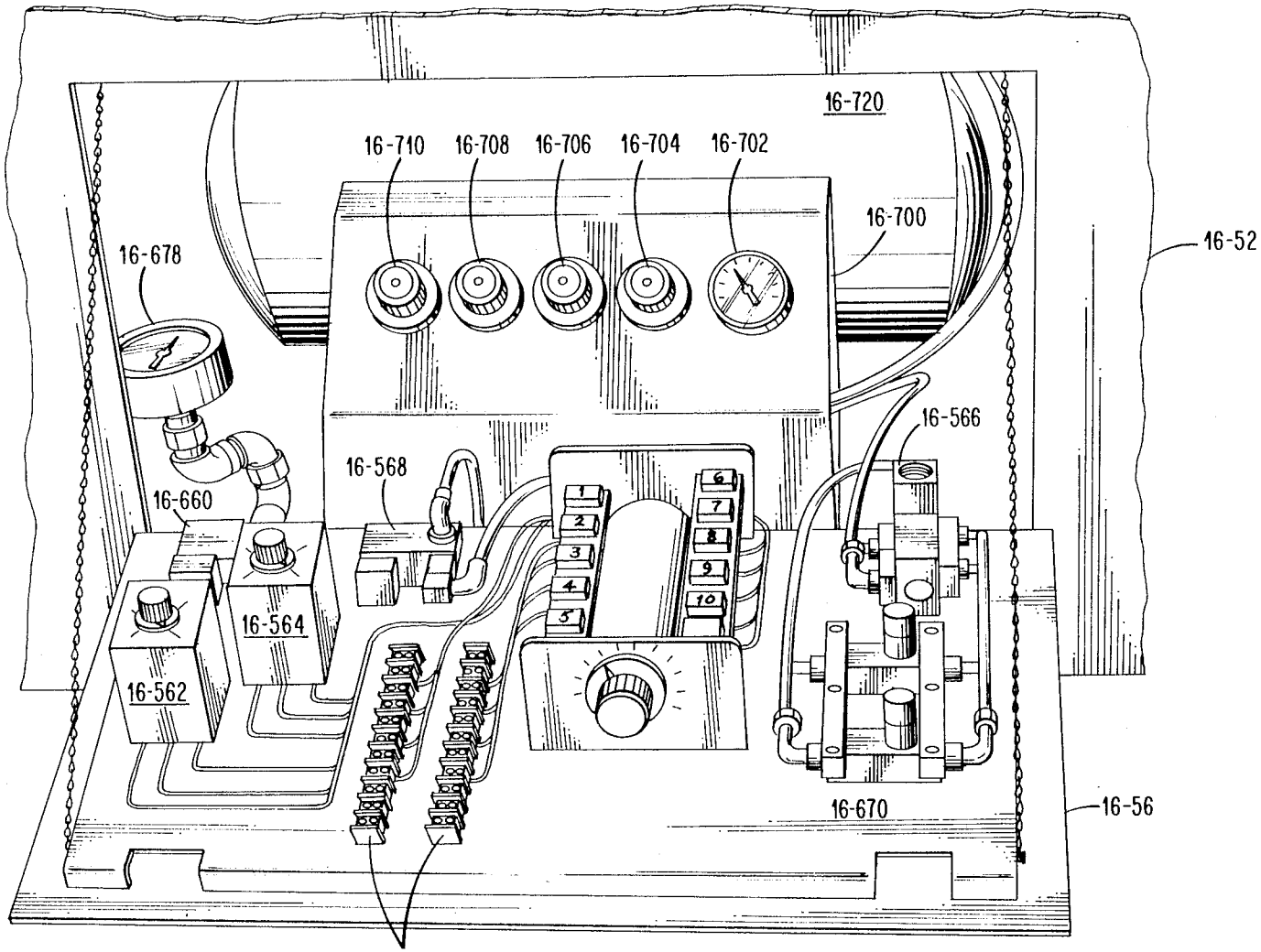
FIG. 7 is a perspective view illustrating the arrangement of control circuits included within the storage and control unit of FIG. 2.

FIG. 7 is a perspective view illustrating the arrangement of control circuits included with storage and control unit 16-3 of FIG. 2. As seen from the Figure, the electrical, pneumatic and mechanical control circuits of FIG. 8 are mounted on the inside of door 16-56.

The electrical and mechanical circuits include a conventional main electronic timer circuit 16-562, a conventional vacuum timer circuit 16-564, a plurality of solenoid circuits 16-566 through 16-660, a pair of air flow needle valves 16-670 which couple to solenoid 6-566, and regulate speed of cylinders 16-15*a* and 6-15*b* and a cam motor driven main timer circuit 16-560 conventional in design. The main timer circuit 16-560 contains ten cam driver microswitches which can be mechanically preset to turn off and on in the proper sequence. The ten microswitches are interconnected through two rows of terminals 16-674 to the other electronic circuits mounted on door 16-56.

FIG. 7 also shows pneumatic circuits which include a vacuum pressure gage 16-678, a main pressure gage 16-702 and a plurality of pneumatic regulator controls 16-704 through 16-710. The controls 16-704 through 16-708 regulate the main air pressure and cylinder air pressure, the plotter platen air pressure and the air separator pressure, respectively. Lastly, the Figure shows a compressed air tank 16-720 which supplies the required compressed air to the pneumatic controls.

FIG. 8 shows in schematic form the arrangement of electrical circuits of FIG. 7. The top switch 6 of the cam driven main timer 16-560 activates the solenoid 16-566 which controls the inward and outward movement of the rods within main cylinders 16-15*a* and 16-15*b*. A next switch 7 also control the cylinder inward and outward movement at a later time. That is, switch 6 controls the outward and inward movement during an unload sequence and switch 7 controls the outward and inward motion during a load sequence. Switch 4 controls the activation of a vacuum switch mounted on a control panel 14-10 of plotter 14. That is, it is used to turn the plotter platen vacuum supply off.

A next switch controls solenoid 16-568 which when activated lets compressed air into air separator 16-38. Switch 3 controls solenoid 16-660 which turns on and off the vacuum to the suction cups 16-242. The vacuum timer 16-564 is connected to work in conjunction with switch 2 which automatically turns on and off the vacuum during the removal of a processed sheet of film from the platen of plotter 14. That is, the timer 16-564 can be set by a knob to establish a predetermined interval from zero to fifteen second interval at which the vacuum will be turned off to cause the suction cups 16-242 to release the sheet of processed film.

A switch 9 is used to turn on and off a solenoid 14-180 located within a base cabinet 14-18 of photoplotter 14 to introduce compressed air to the plotter platen for floating the film on the platen. Switch 8 turns the film handler blower 16-740 on and off which is located inside cabinet unit 16-52 which is used to float the processed sheet of film down onto shelf 16-54. Switch 5 is an unused switch and switch 10 is activated at the completion of a cycle of operation to signal computer 10 of such completion at which time photoplotter 14 can start to plot another piece of film.

The main electronic timer 16-562 controls the operation of cam motor driven timer 16-560. Once a pushbutton switch 16-676 is pressed by the platen of the photoplotter 14, the timer 16-562 turns on and in turn activates the motor driven timer 16-560 and establishes a predetermined time interval between zero and one hundred and twenty seconds for a complete cycle of operation.

DESCRIPTION OF OPERATION

With reference to FIGS. 1 through 4*c*, 7 and 8, the operation of the load/unload mechanism 16 of the present invention will now be described with reference to FIGS. 5*a* through 5*c* and 6*a* through 6*i*. The mechanism 16 operates to unload and load sheets of film from photoplotter 14 permitting continuous photoplotting without manual intervention. This results in a substantive increase in productivity.

As previously mentioned, the loader/unloader mechanism 16 is attachable to the photoplotter 14 without modification to the photoplotter 14. For proper consistent alignment of the mechanism 16 with the photoplotter platen, the two are mechanically linked together by a latching toggle device 16-8 of FIG. 6*a* conventional in design. Toggle device 16-8 when switched into position effectively bolts together the sides of mechanism 16 and photoplotter 14. This arrangement ensures that when the top positioning portion 14—14 of photoplotter 14 moves to an appropriate location at the end of a cycle of operation, it makes proper contact with push-button 16-676. Also, as seen from FIG. 6, it ensures proper alignment of the guide 16-31*a* and way 16-34*a* with the top laser head portion 14-16 of photoplotter 14 for proper positioning of new sheets of film on platen 16-40.

It will be assumed that the loader/unloader mechanism 16 has been loaded with the desired number of unexposed sheets of film. Briefly, this is accomplished by removing the carriage assembly 16-1 and rotating the stop block latch caps 16-372 of FIG. 4*c* counterclockwise exposing the tension cylinders 16-366. Each sheet of unexposed film is placed individually on the loader top plate 16-30. The rear edge of each sheet is placed adjacent to a film stop tab 16-41 and slid back against the stop tab. Then the tension cylinders 16-366 are pushed down and the latch caps 16-372 are rotated to the closed position shown in FIG. 4*c*. After the carriage assembly 16-1 is again placed into the slots of the stop blocks 16-36*a* and 16-36*b*, the mechanism 16 is ready for operation once main power is applied.

Figure 6A:
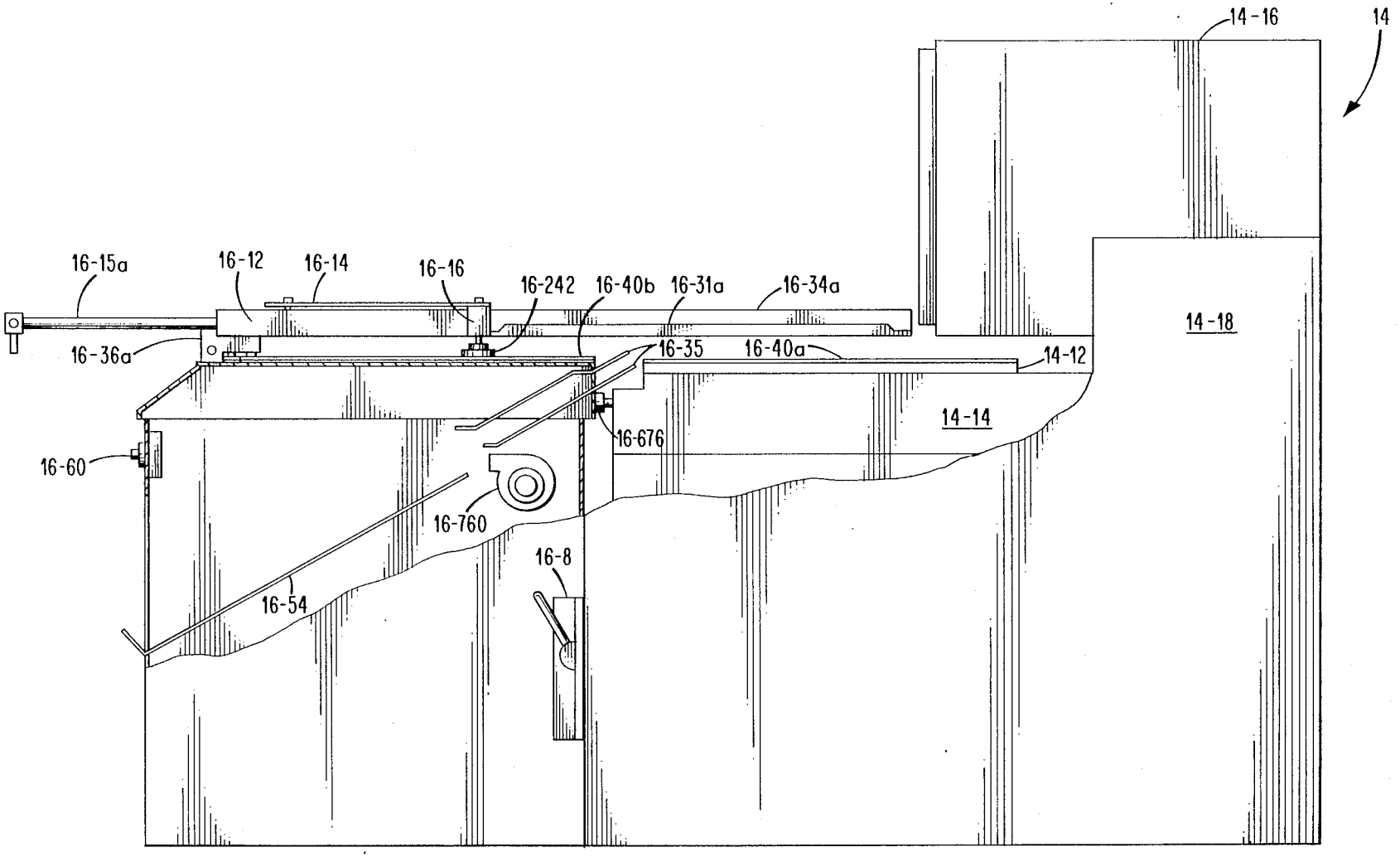
FIGS. 6*a* through 6*a* are used to illustrate the sequence of operations performed by the loader/unloader apparatus of the present invention.

As mentioned, mechanism 16 operates with photoplotter 14 without any alteration in the programming of photoplotter 14. To achieve this, it has been recognized that the start of a cycle of operation begins when the photoplotter platen 14-12 comes out and makes contact with start push button 16-676. FIG. 6*a* illustrates the start position of suction cups 16-242 over the stack of unexposed film 16-40 and a sheet of processed film 16-40*a* on photoplotter platen 14-12.

Figure 6B:
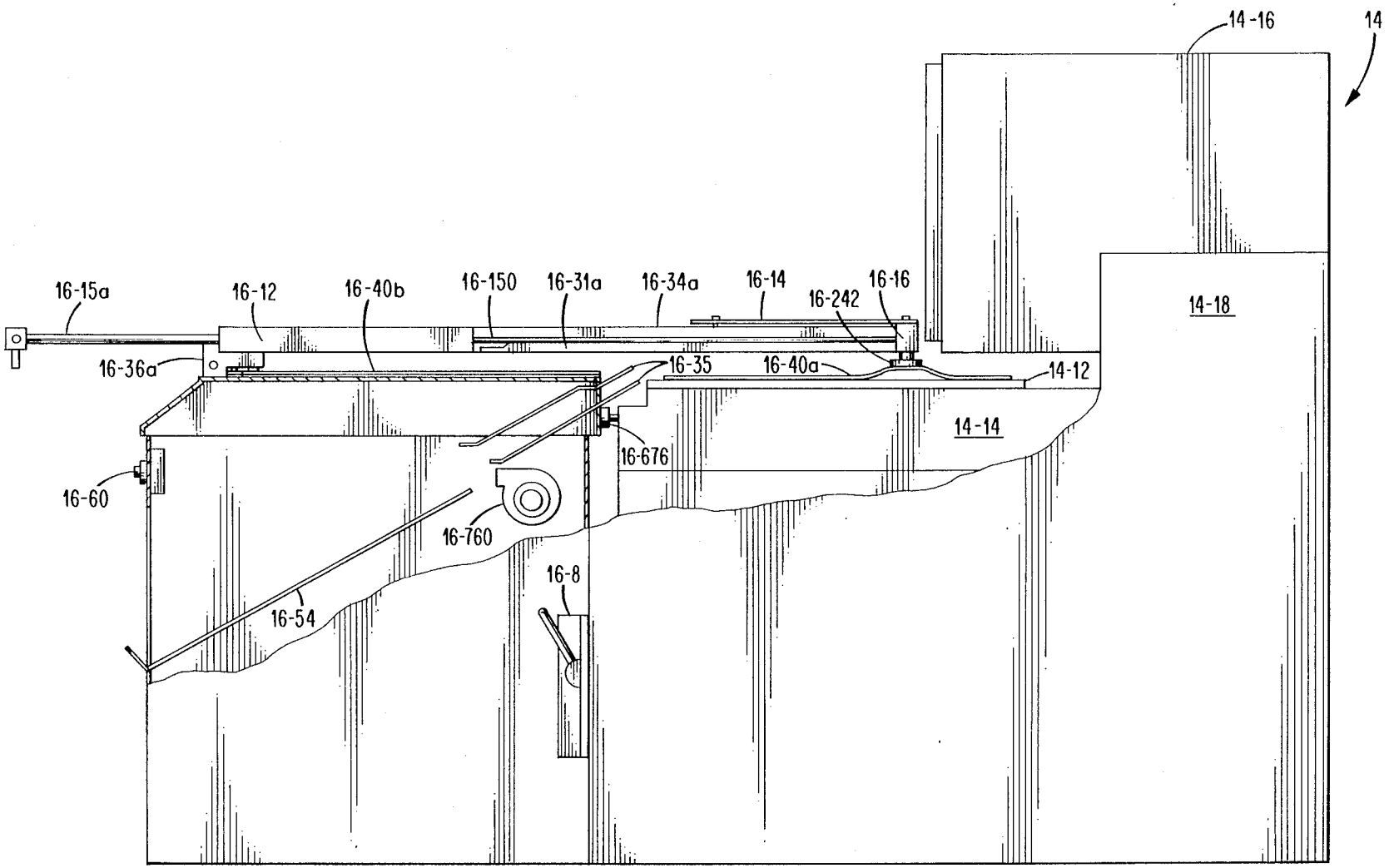

As seen from FIG. 8, the pressing of push-button 16-676 activates timer 16-562 which starts main cam motor driven timer 16-560. The initial series of operations is for an unloading operating in order to pick up and store the sheet of film 14-4*a* processed by photoplotter 14. The first operation in this initial series is shown in FIG. 6*b*. This results in the activation of switch 1 and solenoid 16-566 which move the suction cups 16-242 out so that they are positioned over the top of the processed sheet of film 16-40*a*.

When the suction cups 16-242 come in contact with the sheet of processed sheet of film 16-40*a*, the vacuum in the photoplotter platen 14-12 is turned off at which time compressed air is applied to float or lift the film 16-40*a* up from platen 14-12 as shown. This action is accomplished by the activation of switch 4 of FIG. 8.

Figure 5A:
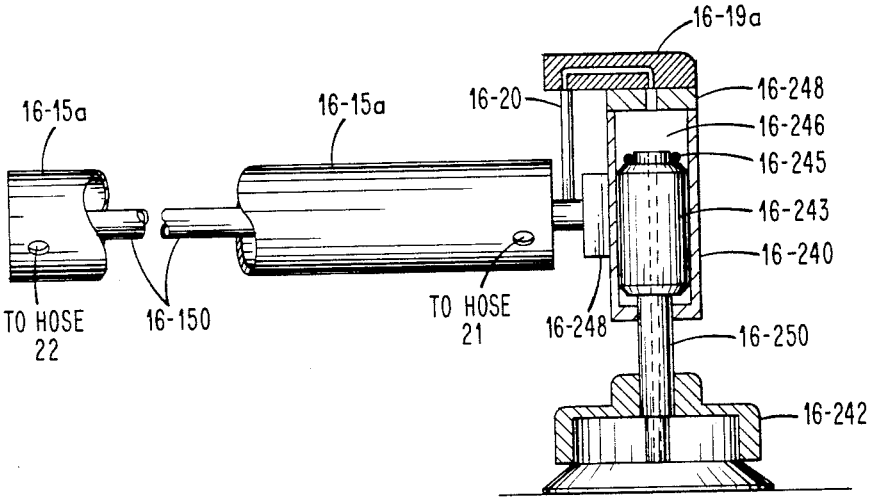
FIGS. 5*a* through 5*c* are used to illustrate the sequence of operations performed by the suction cup gripping apparatus shown in FIGS. 4*a* and 4*b*.
Figure 5B:
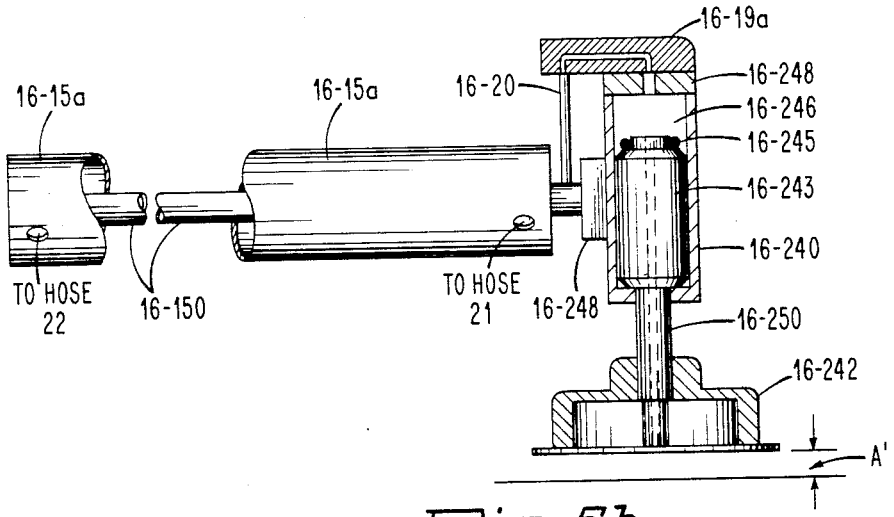
Figure 5C:
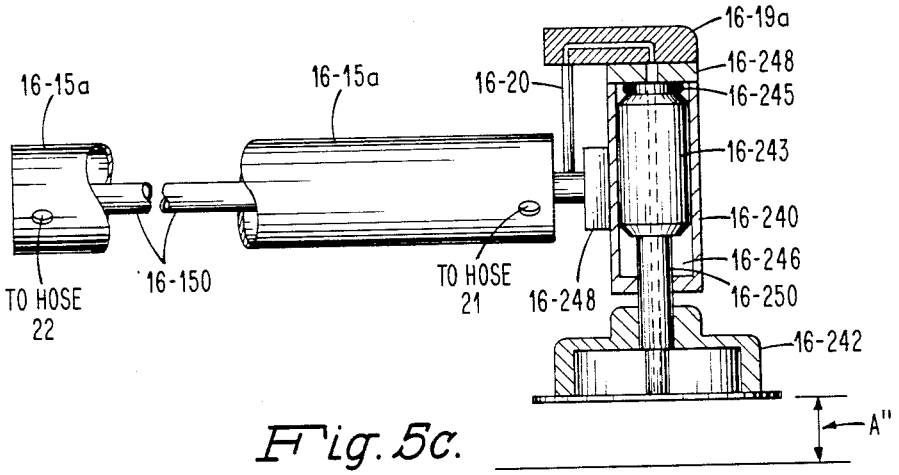

The sequence of operations performed by the suction cups 16-242 in picking up a sheet of film is shown in FIGS. 5*a* through 5*c*. FIG. 5*a* shows the suction cup 16-242 in a rest position when there is no vacuum applied to cylinder 16-243. The activation of switch 3 and solenoid 16-660 causes a vacuum to be applied from the top of bar 16-248, the vacuum is transferred through channel hole 16-243 to the face of the suction cup 16-242. Switch 2 activates vacuum timer 16-564. The vacuum flattens the film on the face of the suction cup which is also flattened as shown in FIG. 5*b*.

Once this action has taken place, chamber 16-246 now sees a maximum vacuum and cylinder 16-243 is drawn in an upward direction to the top of the chamber. When cylinder 16-243 is drawn to the top, the O-ring 16-245 seats against the inside surface of bar 16-248 as shown in FIG. 5*c*, preventing any vacuum leakage. As long as there is a slight vacuum applied to chamber 16-246, the condition of holding or gripping onto the film, lifting it up to a first position (designated by A') and raising it up to a second position (designated by A") persists.

Next, the cylinder rods 16-150 are moved back to the left to a position slightly to the right of chute 16-35. At this time, the sheet of film 16-40*a* is released by suction cups 16-242. The time of release is established by timer 16-564 which after the prescribed time interval times out turning off the vacuum applied to the suction cups 16-242. The timer 6-564 after timing out automatically resets to zero enabling it to again establish the same prescribed time interval when next activated.

Figure 6C:
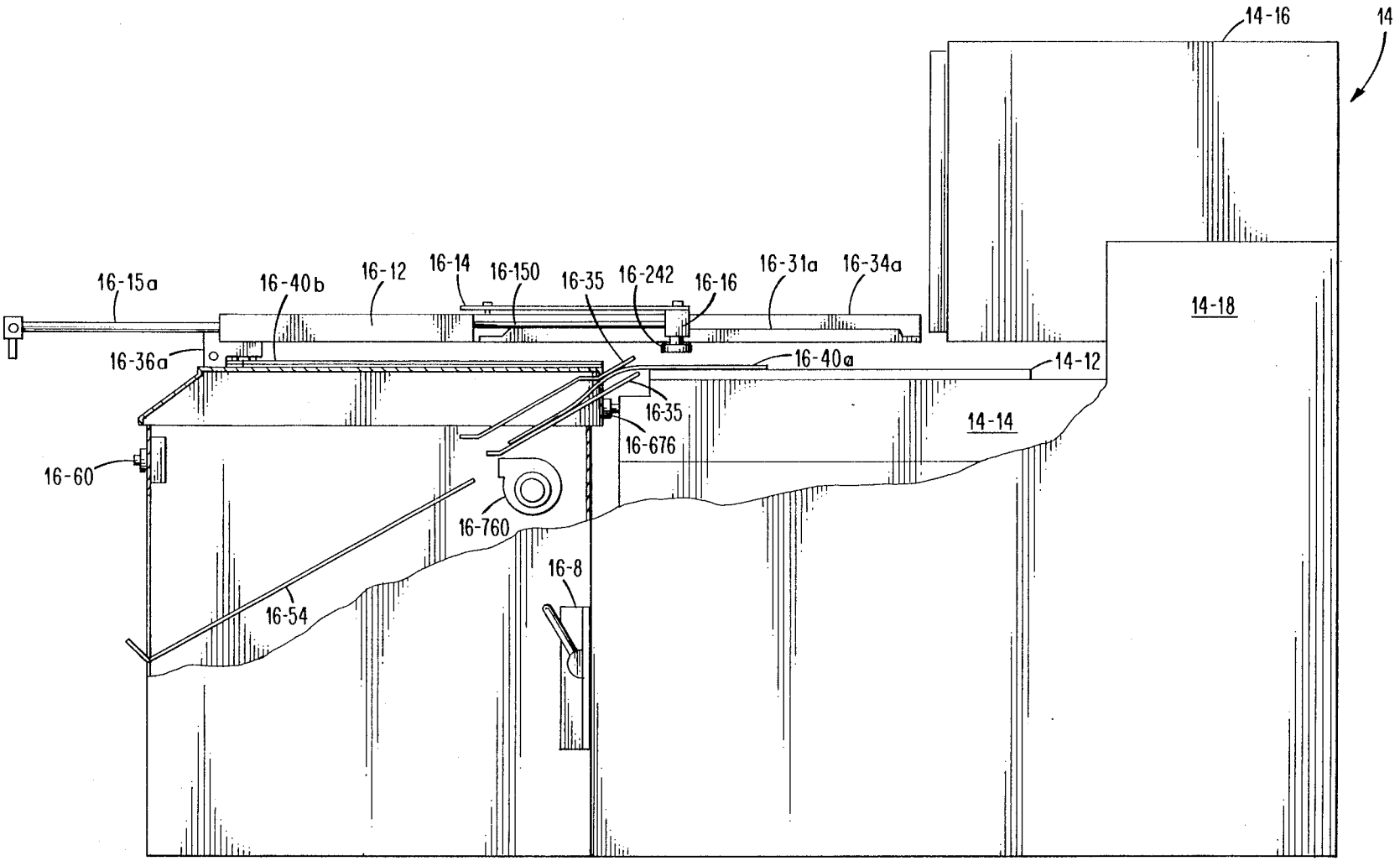

When the vacuum is eliminated, the cylinder 16-15*a* is vented causing air to enter the top of housing 16-240 of FIG. 5*c*. This causes cylinder 16-243 to drop from position A" to the bottom of chamber 16-246 which is the position shown in FIG. 5*a*. Once this action has taken place, the suction cups 16-242 release the sheet of film 16-40*a* into chute 16-35 for deposit in shelf 16-54 for later removal. This is illustrated by FIG. 6*c*.

Figure 6D:
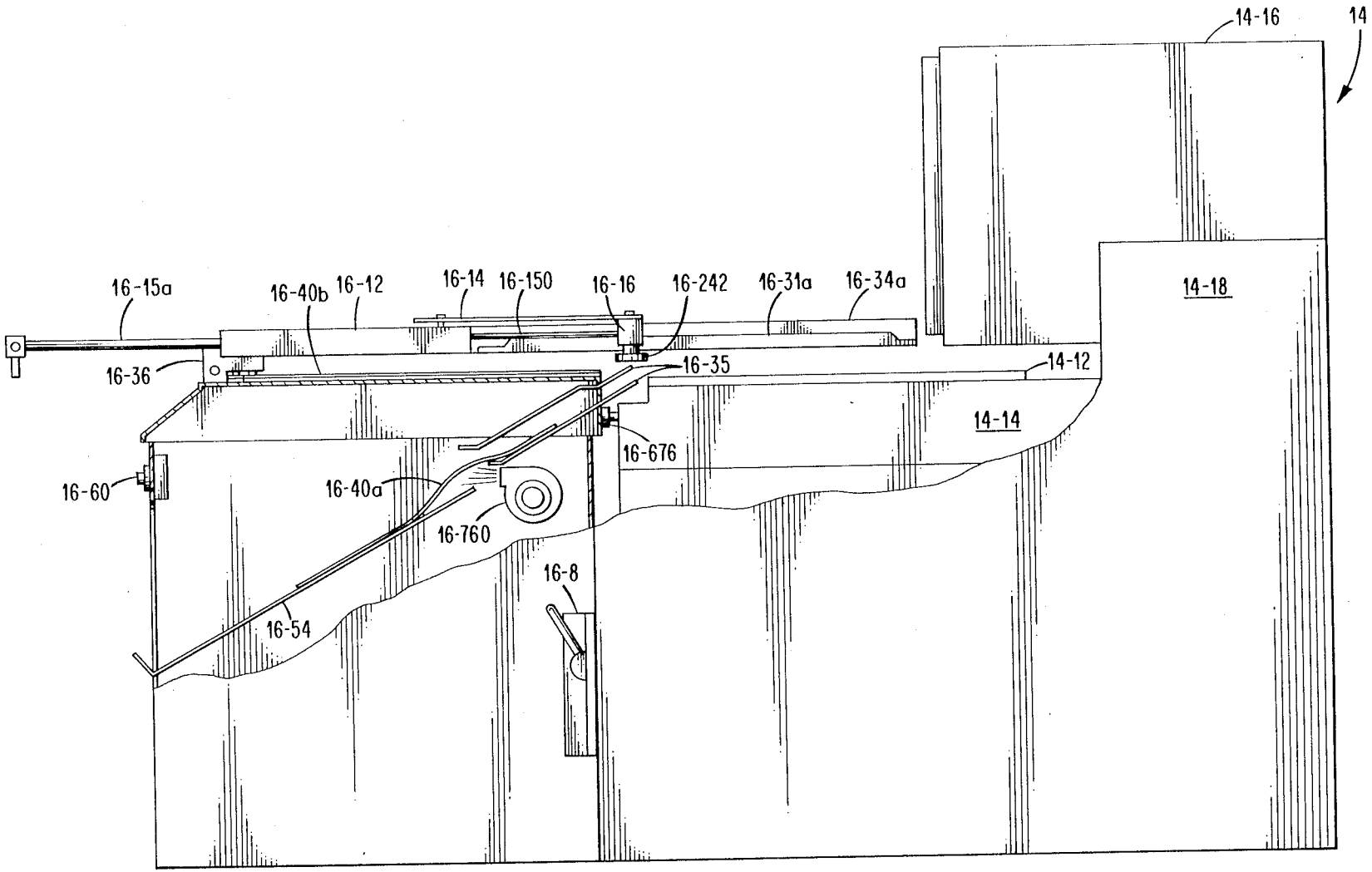
Figure 6A:
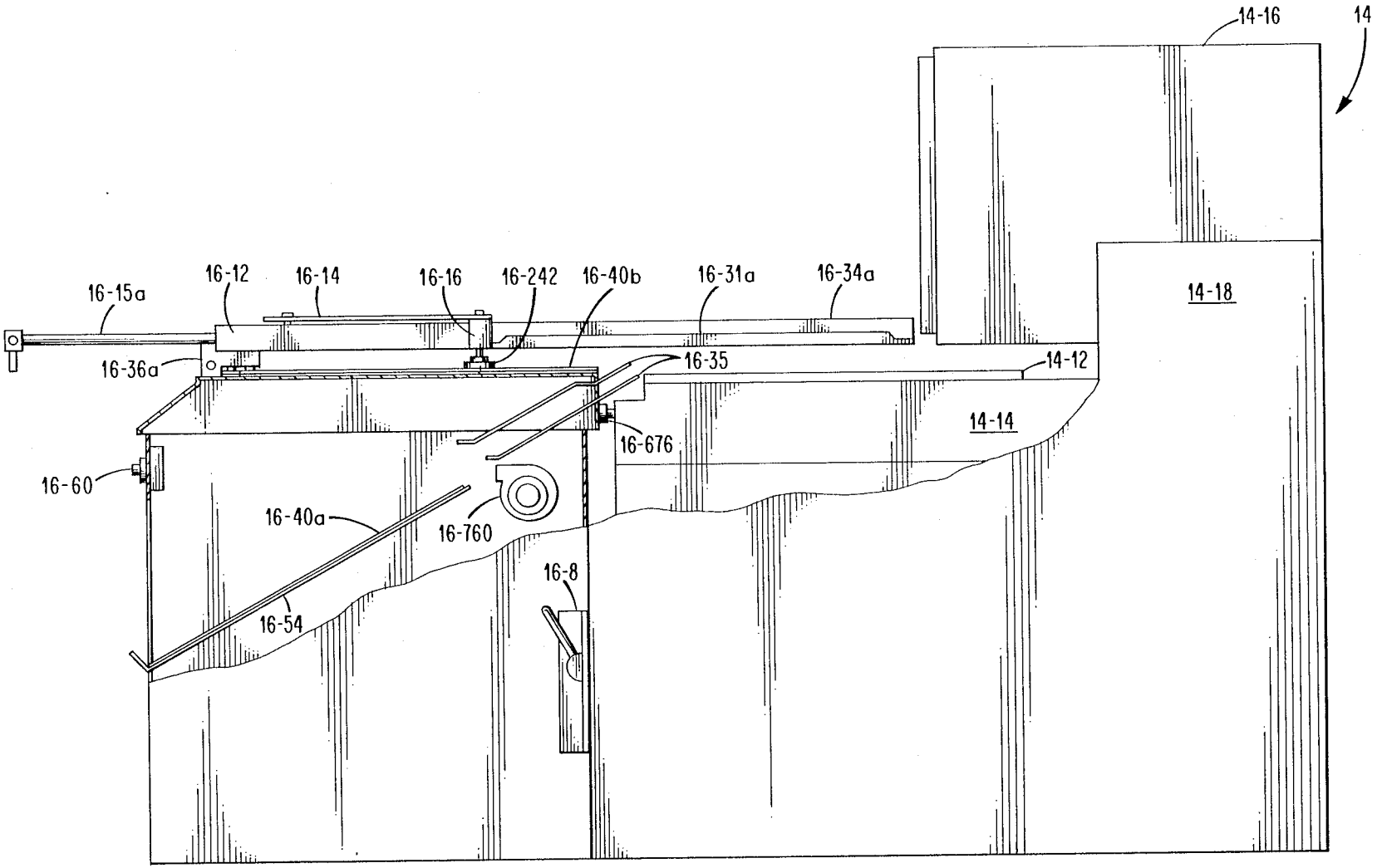

FIG. 6*d* shows the suction cups 16-242 positioned over chute 16-35 following film release after which the sheet of film 16-40*a* is floated down inside cabinet 16-52 The activation of switch 8 turns on blower 16-740 which assists in moving sheet of film 16-40*a* onto shelf 16-54 as shown.

The rods 16-150 continue to retract until the suction cups 16-242 have been returned to their starting position as illustrated in FIG. 6*e*. At this time, there is no sheet of film on photoplotter platen 14-12. At this time, the unload sequence of operation is now complete.

Figure 6F:
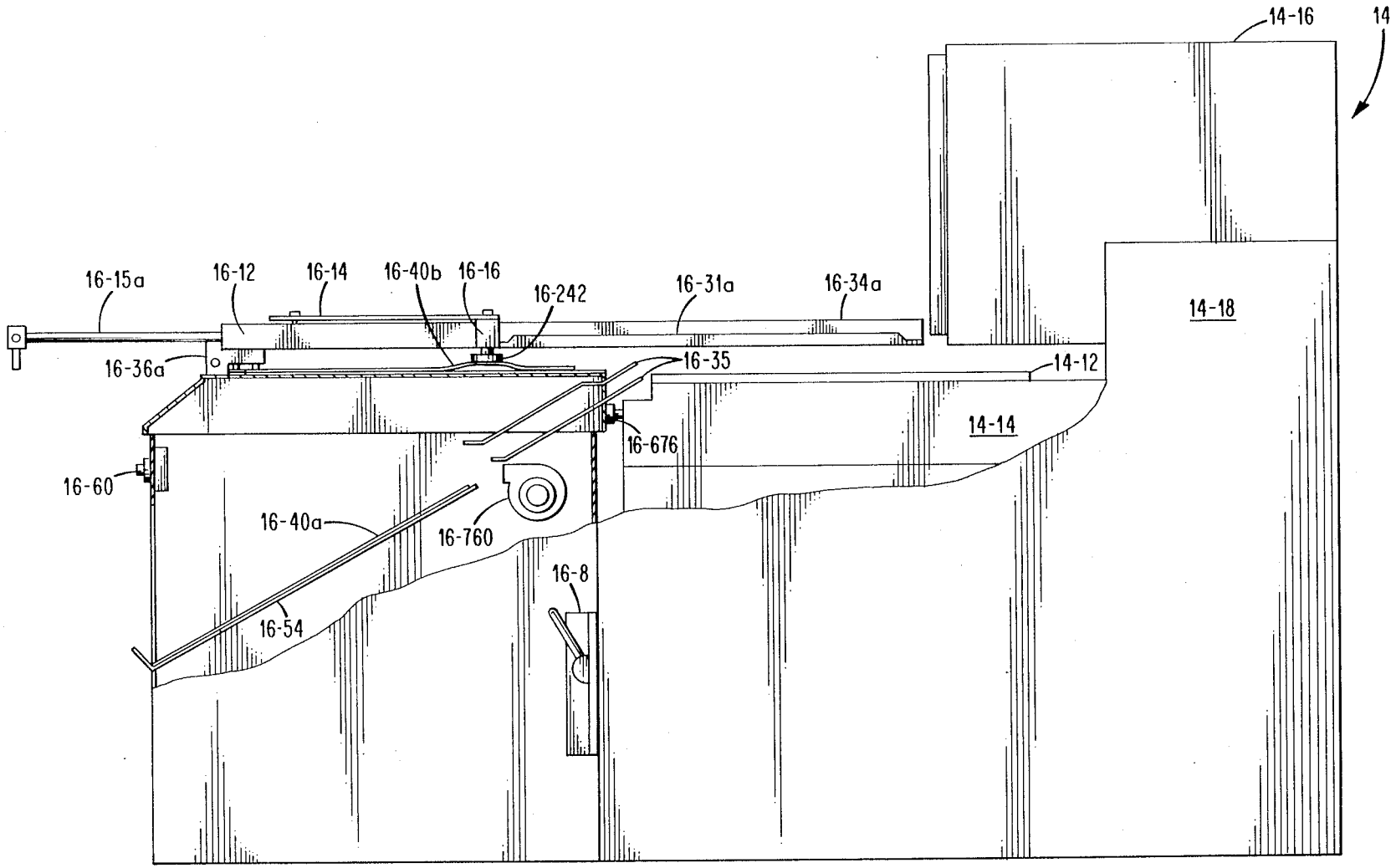

Next, the mechanism 16 begins a series of operations for loading a sheet of unexposed film from the stack of sheets of film on top plate 16-30 onto the photoplotter platen 14-12. First, switch 1 is turned on which activates solenoid 16-568. This applies compressed air to air separator 16-38 which ensures proper separation of the unexposed sheet of film 16-40*b* from the stack. At the same time, switch 3 is activated which applies a vacuum to suction cups 16-242 causing them to repeat the sequence of operations of FIGS. 5*a* through 5*c*. This action is illustrated in FIG. 6*f*.

Figure 6G:
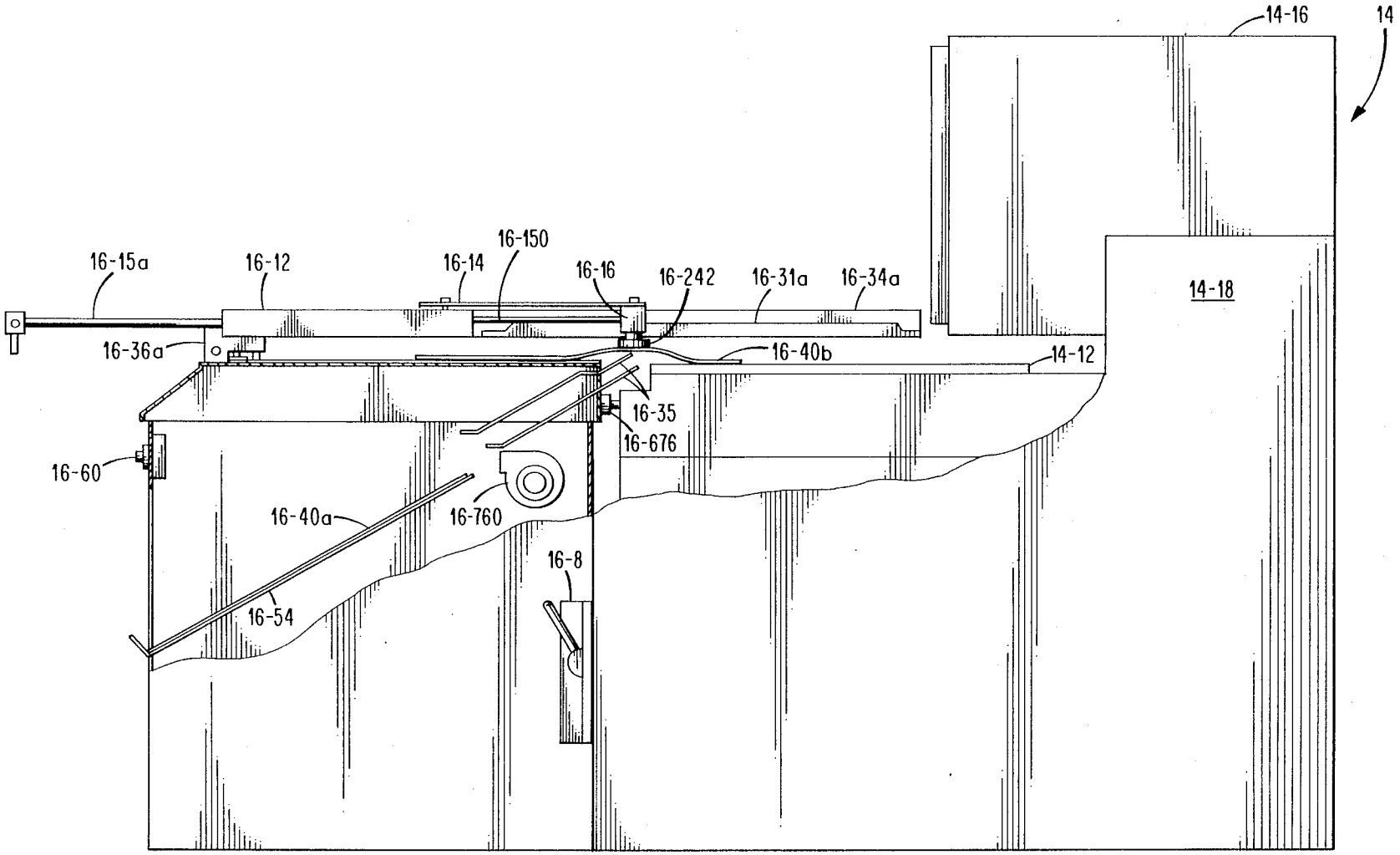
Figure 6H:
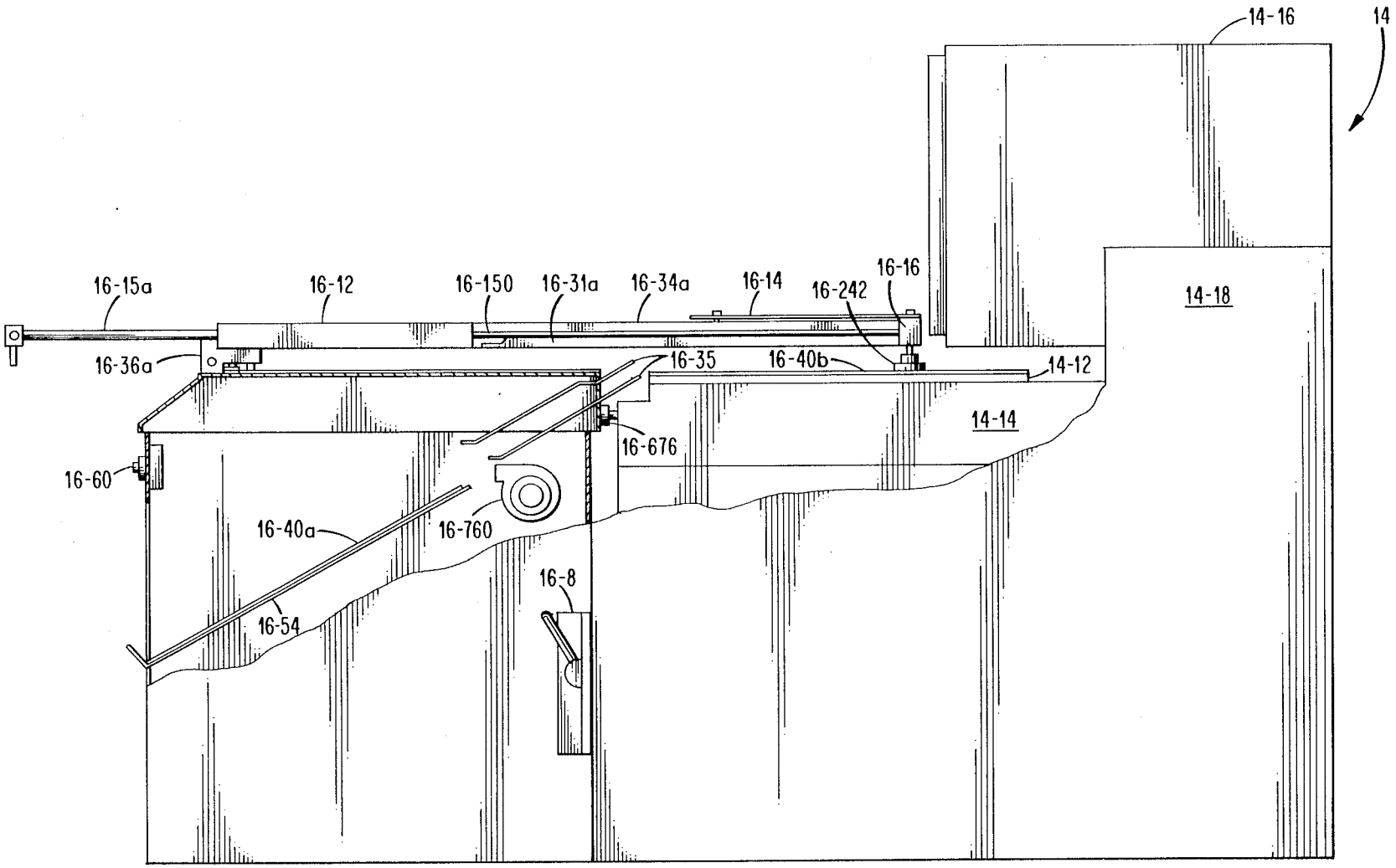
Figure 61:
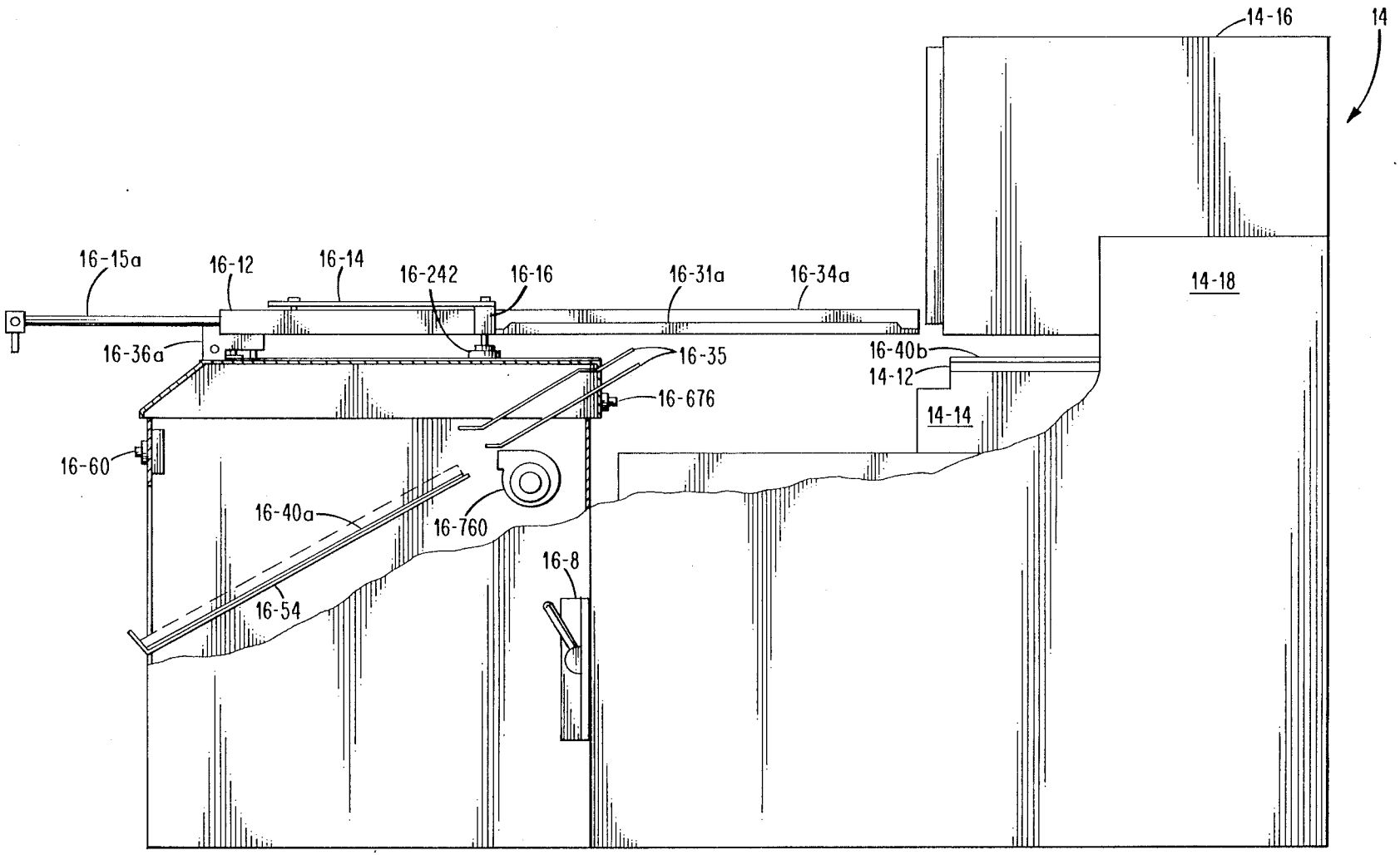

FIG. 6*g* shows the suction cups 16-242 moving the sheet of film 16-40*b* out over chute 16-35 and onto the photoplotter platen 14-12. This action takes place in response to the activation of switch 7. Next, the suction cups 16-242 are moved to a position on top of photoplotter platen 14-12 at which the sheet of film 16-40*b* is deposited. The release of sheet of film 16-40*b* takes place in the same manner as described above. Once the sheet of film 16-40*b* has been released, switch 4 is turned on activating solenoid 16-662. This applies a vacuum to the photoplotter 14-12 platen for holding down the sheet of film 16-40*b* as the rods 16-150 are being retracted. The suction cups 16-242 are returned to the start position shown in FIG. 6*e*.

Once the above sequence of operations have taken place, switch 10 is activated which signals computer 10 that the unload/load sequence is complete. At this time, the computer 10 causes the photoplotter platen 14-12 to be moved into the position shown in FIG. 6*i* for plotting artwork images on sheet of film 16-40*b*. FIG. 6*i* also illustrates how the processed sheets of film are stacked on shelf 16-54 without coming in contact with any portion of unit 16-3 or prior deposited sheets of film.

The entire cycle for completing the unload/load sequence of operations approximates 90 seconds. During this interval, the mechanism 16 performs a first sequence of operations of moving the cylinder rods 16-150 outward picking up a sheet of film and retracting the rods for depositing the film followed by .a second sequence of operations of moving the cylinder rods 16-150 outward for depositing a sheet of film and retracting the rods to their start position. Hence, both sequences are repeated for each complete cycle.

The above has shown how the load/unload mechanism 16 of the present invention operates in conjunction with existing photoplotter equipment to increase its overal productivity. This is accomplished without the use of complex, expensive, robotic systems.

Those skilled in the art will appreciate that many changes can be made to the loader/unloader mechanism of the present invention departing from the teachings of the present invention. Also, the mechanism may be used in conjunction with other photoplotters or with various types of plotting film or media.

While in accordance with the provisions and statutes there has been illustrated and described the best form of the invention, certain changes may be made without departing from the spirit of the invention as set forth in the appended claims and that in some cases, certain features of the invention may be used to advantage without a corresponding use of other features.

What is claimed is:

1. A mechanism attachable to a photoplotter system which has a platen, said mechanism for continuously loading sheets of unexposed film onto said platen for operating said photoplotter system continuously without manual intervention, said mechanism comprising:

a movable assembly for individually loading said unexposed sheets of film by picking up each sheet and depositing said sheet on said platen for enabling said photoplotter system to perform a photoplotter operation thereon and in response to a signal from said photoplotter system indicating the completion of said photoplotter operation on said sheet of film unloading each processed sheet by picking up said photoplotted sheet from said platen and depositing said each photoplotted sheet for storage; and, storage means coupled to said movable assembly, said storage means including means for storing photoplotted sheets of film; and a single control means being coupled to said movable assembly, said single control means generating signals for controlling the operation of said movable assembly, said single control means being coupled to said photoplotter system and responsive to said signal from said photoplotter system to generate in succession first and second sequences of signals which define a cycle of operation, said first sequence of signals causing said movable assembly to move from an initial position adjacent said unexposed sheets to pick up and unload a photoplotter sheet from said platen deposit said sheet in said means for storing followed by a return to said initial position and said second sequence of signals causing said assembly to pick up a next unexposed sheet and deposit said next unexposed sheet on said platen followed by the return of said assembly to said initial position completing said cycle of operation, said single control means enabling said system to continuously carry out successive plotting operations of different durations interrupted only by said cycles of operation initiated by said single control means in response to said signal from said photoplotter system.

2. The mechanism of claim 1 wherein antistatic sheets of paper are placed between each of said sheets of unexposed film and wherein said storage and control means further includes:

a pair of stop block means, each of stop block means being positioned near each end of the back of said sheets of paper for mechanically holding said unexposed sheets of film and said sheets of paper in place during said continuous operation of said mechanism.

3. The mechanism of claim 2 wherein said sheets of paper installed underneath said stop block means are laminated with a plurality of film separator stop tab pieces which act as a stop for said sheets of unexposed film and provide air space between said sheets of paper.

4. The mechanism of claim 3 where each of said stop blocks includes adjustable tensioning means for providing a predetermined downward pressure on said stop tab pieces and sheets of papers to hold said unexposed sheets of film in place and to provide a desired amount of friction for withdrawing an unexposed sheet of film at a time.

5. The mechanism of claim 3 wherein said storage and control means further includes air separator means coupled at each end to a different one of said stop block means for receiving compressed air, said air separator means having a plurality of holes calibrated for blowing air into said back of said unexposed sheets of film for individual pickup.

6. The mechanism of claim 2 wherein each of said stop block means includes a slot for the correct positioning of said movable assembly within a top portion of said mechanism thereby facilitating sheet loading.

7. The mechanism of claim I wherein said movable assembly includes movable cylinder means and gripping means, said gripping means having:

a bar member containing a plurality of cylindrical chambers, a plurality of cylinders housed within different ones of said chambers and a corresponding number of suction cup means connected to a different one of said plurality of cylinders; and pneumatic means including said movable cylinder means connected to said plurality of cylindrical chambers for applying a vacuum to said chambers for causing suction cup means to grip individual exposed and unexposed sheets of film and move said each sheet through the same predetermined sequence of positions as required for depositing said exposed and unexposed sheets of film for storage and for storage and on said platen respectively.

8. The mechanism of claim 1 wherein said means for storing includes shelf means for storing said processed sheets of film;

chute means positioned adjacent to said shelf means for directing each of said processed sheets of film onto said shelf means; and, blower means positioned under said chute means for floating said each of said processed sheets of film received by said chute means down onto said shelf means for storage.

9. The mechanism of claim 8 wherein said chute means includes a pair of members positioned at a predetermined angle and parallel to each other for receiving said processed sheet of film therebetween said members.

10. A loader/unloader mechanism fastened to a computer controlled photoplotter device which includes a movable platen, said mechanism for continously loading sheets of unexposed film onto said platen and removing processed film sheets from said platen, said mechanism comprising:

a movable carriage assembly including gripping means and movable cylinder means coupled to said gripping means; and, storage means including:

shelf means for storing said sheets of unexposed film; and chute means positioned adjacent to said shelf means;

a single control means coupled to said gripping means, to said movable cylinder means and to said photoplotter device, said single control means in response to a signal from said photoplotter device indicating that said platen has moved to a predetermined position after having completed the photoplotting of a sheet of film, generating in succession first and second sequences of signals which define a cycle of operation, said first sequence of signals for moving said cylinder means outwardly an inwardly to enable said gripping means to pick up a processed sheet of film from said platen and deposit said sheet through said chute means for storage on said shelf means and said second sequence of signals for enabling said gripping means to pick up one of said unexposed sheets, move said cylinder means outwardly and inwardly to enable said gripping means to deposit said one on said platen and return to an initial position removed from said platen, said single control means enabling said system to continuously carry out successive plotting operations which differ in duration interrupted only by each said cycle of operation initiated in response to each said signal from said photoplotter device.

11. The mechanism of claim 10 wherein antistatic sheets of paper are placed between each said sheets of unexposed film and wherein said storage and control means further includes:

a pair of stop block means, each of said stop block means being positioned near each end of the back of said sheets of paper for mechanically holding said sheets of paper in place during said continuous operation of said mechanism.

12. The mechanism of claim 11 wherein said sheets of paper installed underneath said stop block means are laminated with a plurality of film separator stop tab pieces which act as a stop for said sheets of unexposed film and provide air space between said sheets of paper.

13. The mechanism of claim 12 where each of said stop blocks includes adjustable tensioning means for providing a predetermined downward pressure on said stop tab pieces and sheets of papers to hold said unexposed sheets of film in place and to provide a desired amount of friction for withdrawing an unexposed sheet of film at a time.

14. The mechanism of claim 12 wherein said storage and control means further includes air separator means coupled at each end to a different one of said stop block means for receiving compressed air, said air separator means having a plurality of holes calibrated for blowing air into said back of said unexposed sheets of film for individual pickup.

15. The mechanism of claim II wherein each of said stop block means includes a slot for the correct positioning of said movable carriage assembly within a top portion of said mechanism thereby facilitating sheet loading.

16. The mechanism of claim 10 wherein said suction gripping means includes:

a bar member containing a plurality of cylindrical cambers, a plurality of cylinders housed within different ones of said chambers and a corresponding number of suction cup means connected to a different one of said plurality of cylinders; an, pneumatic means including said movable cylinder means connected to said plurality of cylindrical chambers for applying a vacuum to said chambers for causing said suction cup means to grip individual exposed and unexposed sheets of film and move said sheet through the same predetermined sequence of positions as required for depositing said exposed an unexposed sheets of film on said shelf means and on said platen respectively.

17. The mechanism of claim 10 wherein said storage and control means further includes blower means positioned under said chute means for floating said processed sheet of film down onto said shelf means for storage.

18. The mechanism of claim 10 wherein said chute means include a pair of members positioned at a predetermined angle and parallel to each other for receiving said processed sheet of film therebetween.

19. The mechanism of claim 10 wherein said movable carriage assembly includes a pair of guideways positioned adjacent to said photoplotter device, said movable cylinder means being conditioned to move said gripping means outwardly and inwardly along guideways in response to certain ones of said first and second sequences of said signals for properly depositing and positioning respectively, said exposed and unexposed sheets of film.

* * * * *